US005131472A

United States Patent [19]

Dees et al.

[11] Patent Number: 5,131,472

[45] Date of Patent: Jul. 21, 1992

[54] OVERBALANCE PERFORATING AND STIMULATION METHOD FOR WELLS

[75] Inventors: John M. Dees, Richardson; Patrick J. Handren; Terence B. Jupp, both of Midland, all of Tex.

[73] Assignee: Oryx Energy Company, Dallas, Tex.

[21] Appl. No.: 699,987

[22] Filed: May 13, 1991

[51] Int. Cl.[5] ..... E21B 43/26; E21B 43/116; E21B 43/267

[52] U.S. Cl. ..... 166/308; 166/280; 166/284; 166/297; 175/4.52; 175/4.56

[58] Field of Search ..... 166/308, 279, 284, 280, 166/63, 299; 175/4.52, 4.56, 4.54

[56] References Cited

U.S. PATENT DOCUMENTS

| | | | |
|---|---|---|---|
| 2,740,478 | 4/1956 | Greene | 166/63 |
| 3,170,517 | 2/1965 | Graham et al. | 166/308 |
| 3,200,882 | 8/1965 | Allen et al. | 166/308 |
| 3,393,741 | 5/1966 | Huitt et al. | 166/308 |
| 3,923,099 | 12/1975 | Brandon | 166/249 |
| 4,633,951 | 1/1987 | Hill et al. | 166/308 |
| 4,683,943 | 8/1987 | Hill et al. | 166/63 |
| 4,718,493 | 1/1988 | Hill et al. | 166/308 |
| 4,823,875 | 4/1989 | Hill et al. | 166/280 |
| 4,903,772 | 2/1990 | Johnson | 166/299 |
| 5,005,649 | 4/1991 | Smith | 166/308 |

OTHER PUBLICATIONS

SPE 16894 "Perforating a High-Pressure Gas Well Overbalanced in Mud: Is It Really That Bad", by T. E. Bundy and M. J. Elmer, 167-174.

"The Multiwell Experiment—A Field Laboratory in Tight Gas Sandstone Reservoirs", by D. A. Northrop and K. Frohne, *Journal of Petroleum Technology*, Jun. 1990, pp. 772-779.

"Hydraulic Fracturing in Tight, Fissured Media", N. R. Warpinski, *Journal of Petroleum Technology*, Feb. 1991, p. 146.

*Primary Examiner*—Stephen J. Novosad

*Attorney, Agent, or Firm*—Pravel, Gambrell, Hewitt, Kimball & Krieger

[57] ABSTRACT

A method if disclosed for decreasing the flow resistance of a subterranean formation surrounding a well. A high fluid pressure is suddenly applied to the formation and fluid is pumped into the high pressure fractures. The fluid may contain proppant particles.

49 Claims, 3 Drawing Sheets

OVERBALANCE PERFORATING AND STIMULATION METHOD FOR WELLS

BACKGROUND OF THE INVENTION

1. Field of the Invention

This invention relates to a method of stimulating or increasing the rate of fluid flow into or out of a well. In another aspect this invention relates to a method of perforating a well wherein the formation around the perforations is fractured and the fractures thereby formed are propagated by high pressure injection of one or more fluids.

2. Description of Related Art

Well stimulation refers to a variety of techniques used for increasing the rate at which fluids flow out of or into a well at a fixed pressure difference. For production wells, it is important to increase the rate such that production of the well is more economically attractive. For injection wells, it is often important to increase the rate of injection at the limited pressure for which the well tubular equipment is designed.

The region of the earth formation very near the wellbore is very often the most important restriction to flow into or out of a well, because the fluid velocity is greatest in this region and because the permeability of the rock is damaged by drilling and completion processes. It is particularly important to find means for decreasing the resistance to flow through this zone.

Processes which are normally used for decreasing the fluid flow resistance near a wellbore are of two types. In one type, fluids such as acids or other chemicals are injected into a formation at low rates and interact with the rock matrix to increase permeability of the rock. In another type, fluid pressure is increased to a value above the earth stress in the formation of interest and the formation rock fractures. Injection of fluid at a pressure above the earth stress then is used to propagate the fracture away from the wellbore, in a process called hydraulic fracturing. Solid particles, called proppant, are added to the fracturing fluid to maintain a low resistance to fluid flow in the fracture formed by hydraulic fracturing after injection of fluid ceases and the fracture closes. Alternatively, if the formation contains significant amounts of carbonate rock, an acid solution not containing proppant is injected at fracturing pressures to propagate the fracture, in a process called acid fracturing. In some wells, where large increases in production rate are desirable, very large quantities of fluids are injected and a hydraulic fracture may be propagated for hundreds of feet away from a wellbore. In many cases, however, large fractures are not needed and a less expensive fracture extending a few feet or a few tens of feet will overcome the high resistance to fluid flow near the well and will be highly successful economically.

The pressures required to create and to maintain open a hydraulic fracture in the earth vary with depth and location in the earth. The fracture gradient, defined as downhole treating pressure required at the formation to maintain a fracture divided by depth of the formation, varies from about 0.5 psi per foot to about 1.0 psi per foot, but more commonly is in the range from about 0.65 to about 0.8 psi per foot. The fracture gradient is usually measured during fracturing treatments of wells by measuring the bottom-hole pressure instantaneously after pumping of fluids has stopped and before the fracture closes. The fracture gradient in a formation of interest will be known for an area where wells have been fractured. An initial breakdown pressure higher than predicted from the fracture gradient is often required to initiate a hydraulic fracture in a well. At least part of the reason for the breakdown pressure being higher than the pressure to maintain a fracture is the necessity to overcome tensile strength of the rock to initiate the fracture. The breakdown pressure is observed to vary from 0 to about 0.25 psi per foot greater than predicted from the fracture gradient. Therefore, to initiate a fracture around a well, pressures in the range from about 0.5 psi per foot of depth to about 1.25 psi per foot of depth are required.

The effectiveness of fracturing or other well stimulation methods in decreasing flow resistance near a well is often measured by "skin factor." Skin factors are measured by measuring bottom-hole pressures in a well under differing flow conditions. A positive skin factor indicates that the region around the wellbore is more resistive to flow than the formation farther away from the well. Likewise, a negative skin factor indicates that the near wellbore region has been made less resistive to flow than the formation. This lower resistance can be a result of a fracture or fractures created near the well and intersecting the wellbore or of changes in rock permeability near the wellbore.

A variety of methods have been proposed to create relatively short fractures to decrease near wellbore resistance to flow. Of course, the obvious method is to perform a conventional hydraulic fracturing treatment but pump less quantities of fluid and proppant. This method is widely practiced, often under the name "minifrac." Unfortunately, the cost of assembling the equipment for such small jobs limits the usefulness of the minifrac. Other processes have been proposed. U.S. Pat. No. 4,633,951 discloses use of combustion gas generating units and a cased wellbore filled with compressible hydraulic fracturing fluid, such as foam, the fracturing fluid containing proppant particles. The pressure of the compressible fluid is increased to a pressure in excess of the fracturing pressure of the formation—sometimes far in excess. The casing of the wellbore is then perforated to release the compressible fluid and particles through the perforations at high pressures. The fractures formed are sanded off until the perforations become plugged with proppant particles. U.S. Pat. No. 4,718,493, a continuation-in-part of the '951 patent, discloses continued injection of the compressible fracturing fluid after perforating the casing until fluid leak-off causes proppant to plug the fracture back to the wellbore. Proppant at moderate to high concentrations in the fracturing fluid is proposed.

U.S. Pat. No. 3,170,517 discloses a method of creating a relatively small hydraulic fracture from a wellbore by placing a fracturing fluid, which may be an acid or may contain proppant, in a well, building up gas pressure above the fracturing fluid, and perforating the casing of the well. Fracturing pressure of the formation is applied from the gas only until the gas pressure is depleted by flow from the wellbore.

Most wells for hydrocarbon production contain steel casing which traverses the formation to be produced. The well is completed by perforating this casing. Three types of perforating equipment are commonly used: (1) shaped charge, (2) bullet, and (3) high-pressure jets of fluid. The shaped-charge gun is by far the most common. The perforation formed must penetrate the steel casing and preferably will penetrate the zone of damaged permeability which often extends for a few inches around a wellbore as a result of processes occurring during drilling of the hole. The most common method of placing perforating apparatus in a well is attaching it to an electrically conducting cable, called an "electric wire line." This type perforating gun can be run through tubing in a well to perforate casing below the tubing; larger diameter guns can be run in casing only. In recent times, a method of perforating called "tubing-conveyed perforating" has been developed. In this method, apparatus is attached to the bottom of the tubing before it is run into a well and the firing of the charges is initiated by dropping of a bar down through the tubing or by a pressure-activated firing device. Vent valves, automatic dropping of the gun from the bottom of the tubing after firing and other features can be used along with tubing-conveyed perforating.

The use of high pressure gas in a wellbore to clean perforations has been described. In the paper "The Multiwell Experiment—A Field Laboratory in Tight Gas Sandstone Reservoirs," *J. Pet. Tech.* June, 1990, p. 775, the authors describe perforating a zone while the casing was pressurized with nitrogen gas to around 3,000 psi above the formation fracturing stress to achieve excellent communication with the formation, believed to be the result of cleaning the perforations with the high pressure nitrogen and preventing contact of the formation by liquids. Also, the paper "Hydraulic Fracturing in Tight, Fissured Media," *J. Pet. Tech.*, Feb.,1991, p. 151, describes procedures for perforating in high-pressure nitrogen gas.

To increase the effectiveness of fracturing or any other stimulation method, it is important to treat all existing the perforations A variety of "diversion" techniques are used in an effort to insure that fracturing fluid or other stimulation fluid enters all open perforations. Such methods as pumping "ball sealers," pumping gel diverting slugs and pumping oil-soluble resin particles, sized salt, benzoic acid flakes and other sized particles into perforations are commonly used. But all these methods are very limited in their capabilities to divert fluids to every existing perforation.

While there have been a variety of methods proposed for creating small hydraulic fractures and for cleaning perforations around a wellbore, there has remained the long-felt need for an economical method which creates a pattern of high-pressure fractures emanating from all the perforations into a formation, allows for extensive cleaning of the perforations and near-wellbore region around the well and allows for placing a controlled amount of proppant in the pattern of fractures created.

SUMMARY OF THE INVENTION

According to one embodiment of this invention, there is provided a method of stimulating a well by suddenly applying pressures to the formation of interest in excess of fracturing pressure in the formation and pumping fluid into the well before pressure declines substantially below fracturing pressure. According to another embodiment, casing in the well is perforated originally or additionally into the zone of interest by a tubing-conveyed apparatus and the well is pressured with gas pressure and a gas-liquid mixture, the liquid containing solid particles, is pumped into the well immediately after the perforating apparatus operates. In yet another embodiment, a wireline-conveyed perforating apparatus run through the tubing perforates the casing while the well is pressured with gas pressure and fluid is pumped into the well immediately after the perforating apparatus operates. In yet another embodiment, a well previously having perforations is treated by running a pressure-retaining apparatus in the tubing string, pressuring inside the tubing and suddenly releasing the pressure, and thereafter beginning injection of a gas-liquid mixture. In another embodiment, a wireline-conveyed perforating apparatus run into a well not containing tubing perforates the casing while the well is pressured with gas pressure and fluid is pumped into the well immediately after the perforating apparatus operates.

BRIEF DESCRIPTION OF THE DRAWINGS

FIG. 1A and 1B show conditions before and after perforating, respectively.

FIG. 4A and 4B show conditions in the well before and after perforating, respectively.

DESCRIPTION OF THE PREFERRED EMBODIMENTS

Figure 1A:
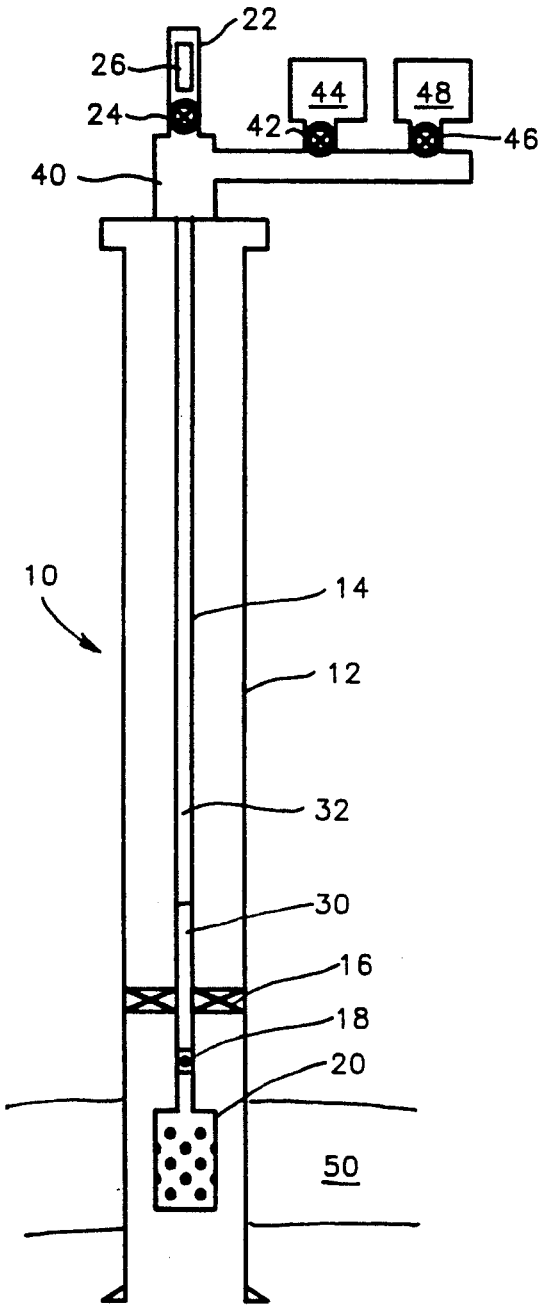
FIGS. 1A and 1B are sketchs of a well containing tubing-conveyed perforating apparatus and surface pumps and equipment for pumping into the well immediately after perforating.

In the description which follows, like components are marked throughout the specification and drawings with the same reference numerals, although the wells illustrated may be different wells.

FIG. 1A is a sketch of equipment placed in a cased well 10 and surface equipment to be described below for practicing one embodiment of this invention. Although the well 10 is indicated in the figures to be in the vertical direction, it should be understood that the well can be drilled at any angle with respect to vertical, including in the horizontal direction. Techniques for drilling horizontal wells are now well known in the industry The formation 50 is a porous and permeable zone of rock which contains hydrocarbons or other fluids.

Casing 12 is placed in the well after drilling and cemented in the wellbore with cement, not shown. Tubing 14 has sufficient burst strength to withstand the high pressures to be applied in the process. Attached near the bottom joint of tubing before it is placed in the well is a vent valve 18 and perforating gun 20. A ported sub may replace the vent valve. In other cases, a gun drop device may replace the vent valve. The tubing is placed in the well by conventional means and the packer 16 set by well known techniques so that a hydraulic seal across the packer is obtained to protect the casing 12 from the high pressures that will be applied to the perforations. The tubing is normally closed at the bottom when it is placed in the well so that it is dry inside when the packer is set. If the tubing is to be pressured primarily by gas, a few gallons of liquid 30 is normally placed in the well to provide a cushion for the apparatus when the apparatus is activated by dropping a bar to pass through the tubing from the surface. Pressure inside the tubing 14 is then increased to the desired value, which is at least such that the pressure at the perforations when the gun 20 is fired will be above the fracture pressure of the formation 50. The pressure is applied to the tubing by opening one of the valves 42 or 46 and operating the corresponding pump to add fluid to the tubing 14. The head for containing and dropping the bar 22 contains a release mechanism 24 which allows the bar 26 to fall through the tubing. The bar passes through the vent valve 18 just before it hits the firing mechanism of the perforating gun 20. On passing through the vent valve 18, the bar opens the valve and allows high pressure from the tubing to be applied inside the casing just as the gun fires.

Figure 1B:
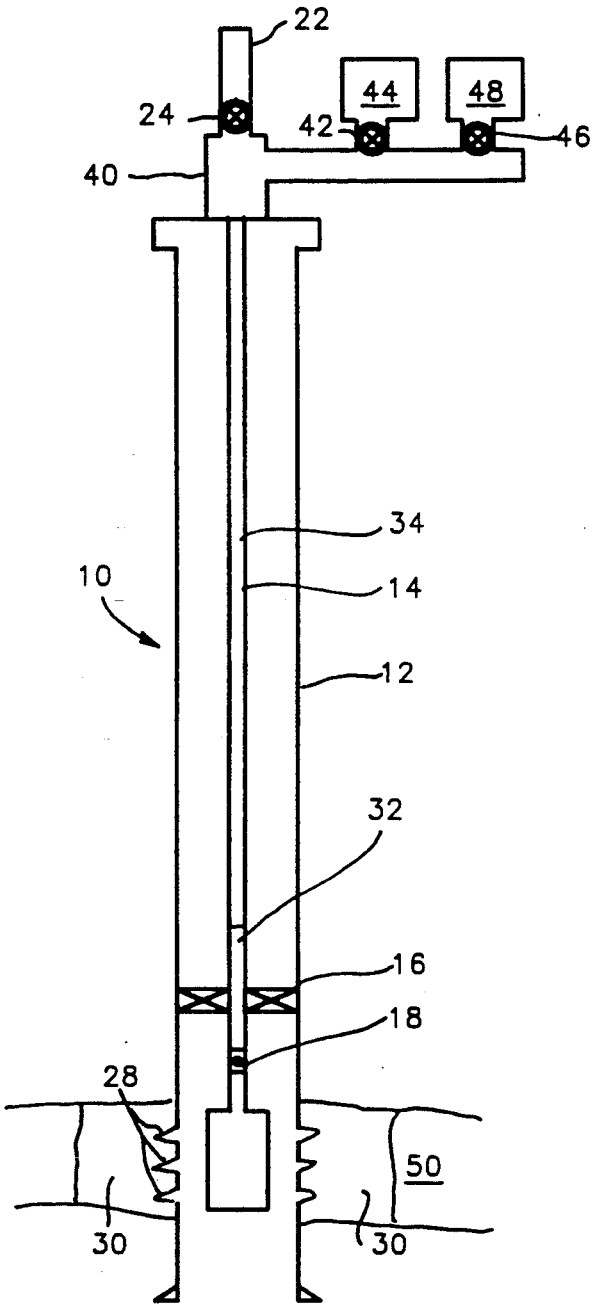

FIG. 1B shows cased well 10 with the vent valve 18 opened and perforations 28 have formed. Fluid 30 has been displaced from the wellbore by high pressure in the tubing and fluid 32 is moving through the tubing. Packer 16 continues to protect the casing above it from the high pressure in the tubing 14. Fluid 34 is being pumped by one or both of the pumps 44 and 48 at the surface of the earth. The pumps are designed to pump liquid, liquid containing solid particles, gas or liquified gas. Any high-pressure source of gas, such as lease gas, can be used.

The above perforating procedure can also be performed by replacing the bar-actuated devices on the perforating assembly with pressure-activated devices. This would allow the entire process to be performed by applying a critical surface pressure to the tubing rather than dropping the firing bar.

Figure 2:
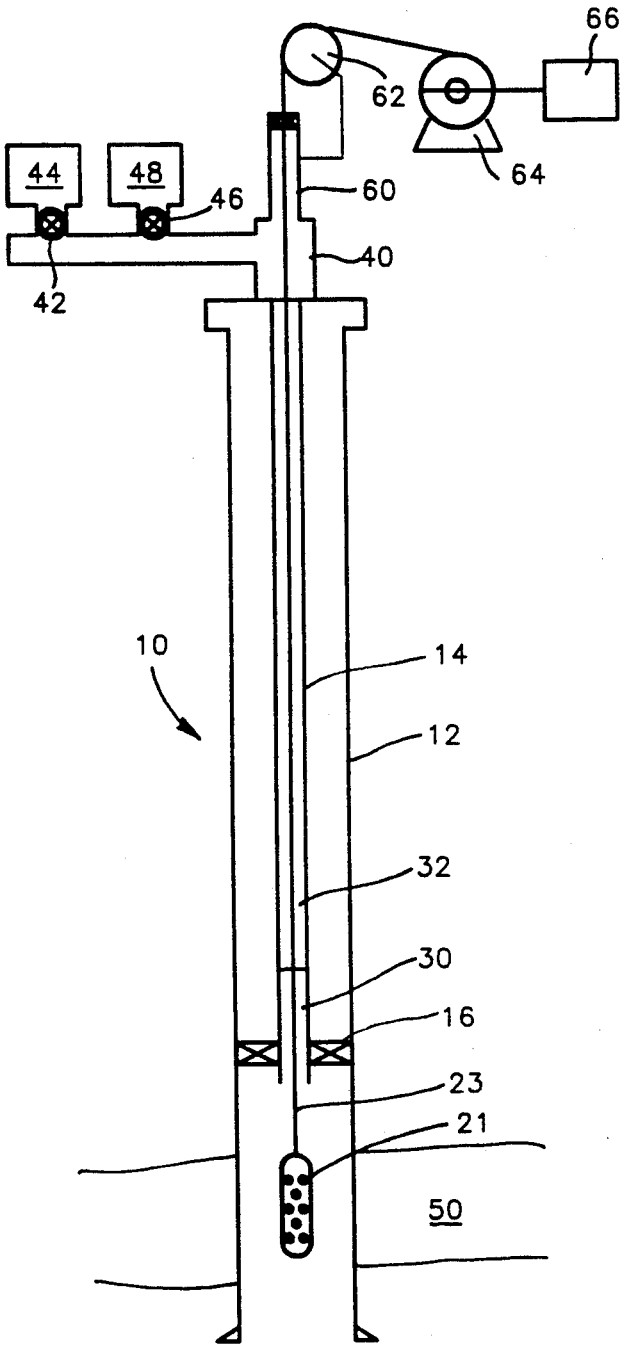
FIG. 2 is a sketch of a well equipped with through-tubing wireline perforating apparatus and surface pumps and equipment for pumping into the well immediately after perforating.

Referring to FIG. 2, the well 10 contains casing 12 and tubing 14. A packer 16 has been set to seal the annulus outside the tubing and prevent high pressures being applied to the casing above the packer. The formation 50 is the zone of interest. A perforating gun 21 has been run through the tubing and placed opposite the formation 50, the gun being conveyed into the well by wireline 23. The perforating gun may be either shaped charge or bullet. Any other method of forming holes in the casing would be equivalent. The wireline is supported at the surface of the earth by a sheave 62 and lowered into or retrieved from the well by a hoist 64. The electric wireline is connected to a control unit 66 for firing the gun and measuring depth. Pumps 44 and 48 are connected through valves 42 and 46, respectively, to a high pressure wellhead 40. Fluid is pumped into the tubing by either pump 44 or 48, or both, until the pressure inside the tubing reaches the desired value, at least above the fracture pressure of the formation 50. The perforating gun 21 is then fired from the control unit 66. Before the surface pressure in the tubing has dropped substantially, pump 44 or pump 48 or both are started and fluid is introduced into the tubing at a high rate, preferably at a rate sufficient to maintain open the hydraulic fractures in the zone 50. The pumps are designed to pump liquid, liquid containing solid particles, gas or liquified gas. Any source of high pressure gas can be used, such as lease gas.

Alternatively, in some wells casing 12 has perforations into the formation 50 (not shown). In such wells, the method of this embodiment can be employed by plugging existing perforations by injecting solid particles into the well. Such solid particles as ball sealers, degradable polymeric materials, wax, rock salt and other materials are well known in industry as diverting materials. When existing perforations are effectively plugged, such that flow from the wellbore is at a low rate, the perforating means 21 may be placed in the well on wireline 23, if it has not been previously placed in the well, and fluid is pumped into the tubing by either pump 44 or 48, or both, until the pressure inside the tubing reaches the desired value, at least above the fracture pressure of the formation 50. The same procedures are followed thereafter as in wells having unperforated casing.

Figure 3:
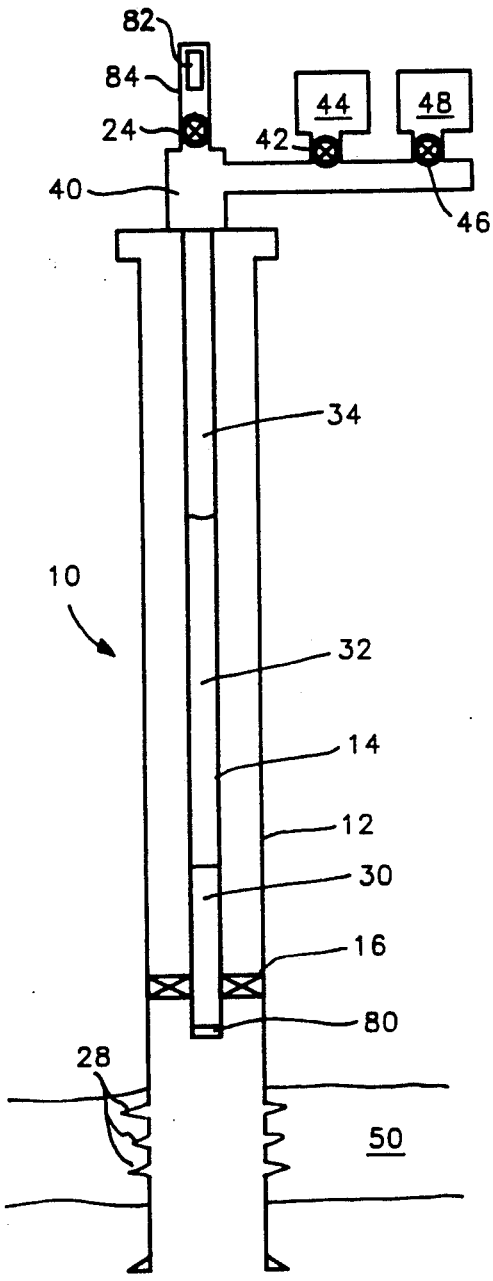
FIG. 3 is a sketch of a well equipped with tubing having a frangible disc which is broken to suddenly apply pressure to pre-existing perforations.

Referring to FIG. 3, a cased well 10 contains casing 12 and tubing 14. A packer 16 has been set to isolate the annulus from high pressure. The well has previously been perforated into the formation of interest 50 having perforations 28 through the casing 12. In this embodiment, the addition of perforations is not required. A frangible disc 80, made of glass, ceramic, cast iron or other brittle material, has been placed in a predetermined position in the tubing string, not necessarily at the bottom but near the bottom, before the tubing is placed in the well. Such discs are available in the industry from Baker-Hughes, Schlumberger, Halliburton and other companies. Alternatively, a valve replaces the frangible disc, the valve being operable by changes in pressure in the tubing-casing annulus. Such valves are sold in industry by Halliburton under the name LPRN, APR. Pressure inside the tubing is increased by operation of pump 44 or pump 48 or both to the desired level of pressure. When frangible disc 80 is present, a bar 82 is then released from the head 84. The bar drops through the tubing 14, striking the disc 80 and causing it to rupture. The pressure inside the tubing is then applied to the existing perforations 28. Before the surface pressure has substantially dropped, pump 44 or 48 or both are started to inject fluid into the well at a high rate to maintain pressure at the perforations above fracturing pressure of the formation 50.

Figure 4A:
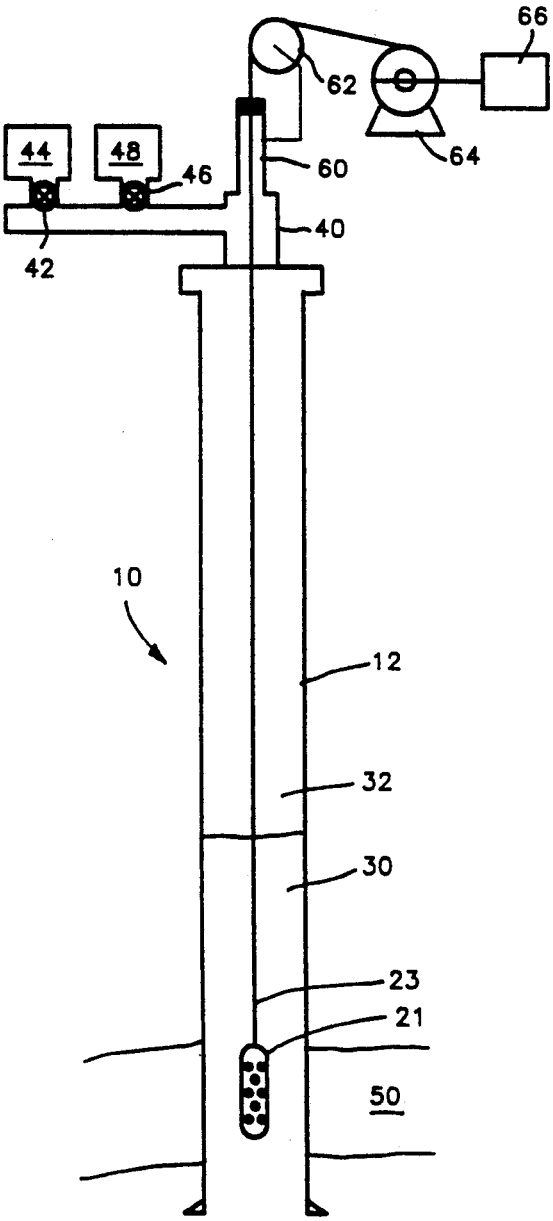
FIG. 4A and 4B are sketchs of a well without tubing and with a casing perforating gun which has been placed in the well on wireline.
Figure 4B:
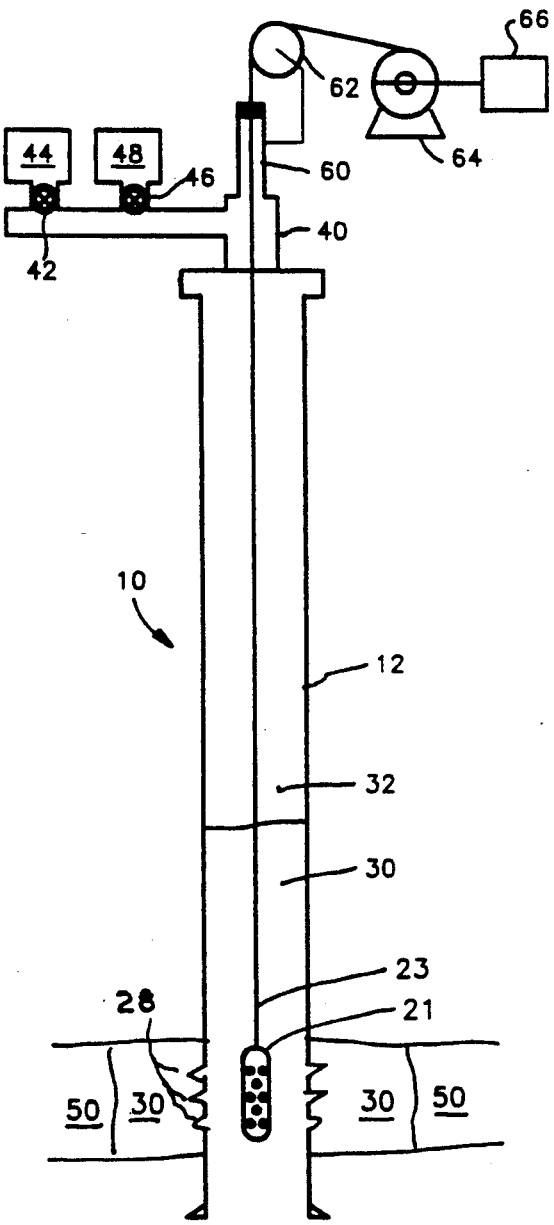

In FIG. 4A and FIG. 4B another embodiment of this invention is shown. No tubing is present in the well 10 and perforating gun 21 is lowered on wireline 23 to a formation of interest 50. Pressure is then applied inside the casing 12 using the method described above for wells having tubing. The perforating gun 21 is fired and perforations 28 are formed in the casing 12, as shown in FIG. 4B. Fluids are then injected as described above for wells in which tubing is present.

Alternatively, in some wells casing 12 has perforations into the formation 50 (not shown in FIG. 4A). In such wells, the method of this embodiment can be employed by plugging existing perforations by injecting solid particles into the well. Such solid particles as ball sealers, degradable polymeric materials, soluble wax, rock salt and other materials are well known in industry as diverting materials. When existing perforations are effectively plugged, such that flow from the wellbore is at a low rate, the perforating means 21 may be placed in the well on wireline 23, if it has not been previously placed in the well, and fluid is pumped into the casing by either pump 44 or 48, or both, until the pressure inside the tubing reaches the desired value, at least above the fracture pressure of the formation 50. The same procedures are followed thereafter as in wells having unperforated casing.

Referring to either of the methods of applying pressure to the formation described by FIGS. 1A, 1B, 2, 3, 4A, and 4B, the pressure at the bottom and inside tubing or casing before perforating is increased to a value such that the pressure when applied to the formation 50 will be in excess of the fracturing pressure of the formation. The fracturing pressure, normally estimated from results in other nearby wells, is sufficient to form at least one hydraulic fracture in one plane of the rock surrounding the well, this plane being perpendicular to the least or first principal earth stress in the formation 50. Typical values for the first principal stress are from about 0.5 to about 0.8 psi per foot of depth, although values exceeding 1.0 psi per foot of depth are observed. Preferably, this pressure applied to the formation 50 is greater than the second principal stress in the formation, and most preferably it is at least about 1.0 to 1.2 psi per foot of depth of the zone 50.

The fluids in the well may be liquid or gas. Preferably, there is sufficient gas in the well such that the fluid is compressible to the degree that time is allowed for opening the valve 42 or valve 46 and starting the pump 44 or pump 48, or both, before the pressure has substantially declined below fracturing pressure. However, if sufficient care is taken to start the pumps quickly, gas may not be necessary and brief pressure drops below fracturing pressure are tolerable. Automatic starting of fluid injection when the means for perforating is activated can be used to minimize the amount of pressure decline. Preferably, additional fluid is pumped into the well while the fractures created by the high pressure are still open. The time required for the high pressure fractures to close will depend on the fluid leak-off rate into the formation and the compressibility of the fluid in the tubing.

Forming perforations or suddenly applying pressure to existing perforations with sufficiently high pressures present in the wellbore is believed to make possible opening and maintaining open fractures in more than one plane in the formation. Also, the high pressure present at all perforations insures that fluid will enter and fracture every perforation. This "diversion" effect to all perforations is believed responsible for a significant amount of the improved benefits from this invention. Another significant amount of the benefits is believed to come from the high-pressure fracture pattern that is formed around the perforations and the increase in size of the fractures by subsequent injection of fluid before the high-pressure fractures have had sufficient time to "heal." Of course, it is not possible to determine the benefits contributed by each of these phenomena independently. The results from experiments in wells, however, support the belief that much improved benefits are obtained by the methods of this invention.

Referring to either FIG. 1A, FIG. 2 or FIG. 3, it is desirable to have the casing filled with liquid below the packer. This condition is achieved by insuring that the liquid level in the casing when the packer is set is higher than the packer setting depth. Minimum compressibility of this liquid-filled region allows higher pressure to be applied to the formation when the perforating gun is fired or pressure is released from the tubing. This liquid may be brine, oil, acid or other liquid. The preferred fluid is placed in the well before the packer is set.

Referring to all the figures, the fluids 30, 32 and 34 can vary, but preferably 30 is a liquid—either water, brine, acid solution or oil. The higher viscosity of a liquid is favorable for opening the fractures created at high pressure. The fluid 32 is preferably a gas. Suitable gases include nitrogen, methane, natural gas, or carbon dioxide. Nitrogen injected by a nitrogen pump is a preferred gas. Techniques for pumping liquid nitrogen converted to gas at the well site are known in industry. The fluid 34 is a liquid or gas, but preferably is a mixture of a liquid containing solid particles and a gas where the formation 50 is a sandstone formation and liquid acid solution and a gas where the formation 50 is a carbonate formation. The solid particles may be of the type normally used as proppants in hydraulic fracturing of wells. Suitable particles are sand and high-strength ceramic proppants well known in the art of hydraulic fracturing. The particles may range in size from about 100 mesh to about 8 mesh, but preferably are in the size range from about 16 mesh to about 40 mesh. The concentration of particles in the liquid stream being pumped may vary in the range from about 0.1 pounds per gallon to about 20 pounds per gallon, but preferably is in the range from about 1 pound per gallon to about 6 pounds per gallon of liquid. The volume of liquid containing proppant that is pumped per volume of mixture may vary from about 5 per cent of total volume to about 95 per cent of total volume. Preferably the liquid volume is in the range from about 5 per cent to about 20 per cent of total volume of the liquid and gas under surface pressure pumping conditions. The liquid may be brine, water or oil, with or without viscosifiers, or acid solution.

Injection of the liquid-gas mixture at the surface preferably begins as soon as pressure is applied to the formation 50, either from firing a perforating gun, breaking a disc or opening a valve. Preferably, the fluid in the tubing or casing is sufficiently compressible that the surface valves can be opened and the surface pumps can be started as soon as any pressure drop has occurred at the surface.

The volume of the liquid-proppant-gas mixture pumped will depend on conditions in each well. An amount is pumped to clean perforations and prop fractures for at least a few feet away from the wellbore. The amount of solid particles or proppant pumped will normally range from about 50 pounds to about 1,000,000 pounds, and preferably will be in the range from about 100 pounds to about 100,000 pounds.

After the fluid injection into a well has ceased, the well may be opened to production. Preferably, the well is placed on production immediately after pumping in of fluids has ceased. Waiting periods of time before opening the well to production may be necessary if viscosifiers are used in any of the fluids, and this procedure will still allow high increases in productivity of wells.

EXAMPLE 1

A well in West Texas was drilled and cased to a depth below 6000 feet. An assembly consisting of a VANN SYSTEMS perforating gun, a VANN Auto-release firing head, a VANN Bar Pressure Vent and a Guiberson Packer was attached to the bottom joint of the 2⅜ inch tubing in the tubing string. The assembly was lowered in to the well on the tubing string and located with the top of the perforating gun at depth of 5722 feet. The packer was set and pressure inside the tubing was increased to 7000 psi by pumping nitrogen at the surface, resulting in a bottom-hole pressure of about 8000 psi. A bar was released at the surface which opened the vent, fired the perforating gun and dropped the perforating gun from the tubing. When surface pressure suddenly dropped, nitrogen pumping began at a rate of 10,000 cubic feet per minute and a pressure of 4240 psi. Shortly thereafter, oil pumping began along with the nitrogen. Sand having a size of 20/40 mesh was then added to the oil. Totals of 367 thousand cubic feet of nitrogen, 1000 gallons of oil and 1000 pounds of sand were pumped into the well. The final surface pumping pressure was 4140 psi. The pressure dropped immediately to 3050 psi when pumping stopped, indicating that the fracturing pressure of the formation was 3690 psi, or the fracturing gradient was 0.64 psi per foot of depth.

The well was opened for production. After a short production period, a bottom-hole pressure bomb was run into the well and pressure measurements were made. The measured skin factor of the well after the treatment was in the range of −1.7 to −3.5, which shows that the region of the formation near the well had lower resistance to flow than the formation farther from the well. Therefore, production of the well was significantly stimulated by the treatment.

EXAMPLE 2

A well was drilled and cased through a productive sand in West Texas. A VANN perforating system and a packer were run on the 2⅜ inch tubing. The tubing was pressured to 7000 psi at the surface, resulting in a bottom-hole pressure of about 8000 psi. A bar was dropped to fire the guns and the sand was perforated from 5760 to 5777 feet. Pressure dropped from 7000 psi to 4400 psi very rapidly after perforating. Pumping of nitrogen began at a rate of 7000 cubic feet per minute at a pressure of 4500 psi. A total of 200,000 cubic feet was pumped. After pumping of nitrogen ceased the well was opened for production of gas. Pressure measurements were made in the well which indicated a skin factor of 0 to −0.7. The near wellbore permeability damage was removed by the treatment, although only a small amount of stimulation was possible without proppant.

The invention has been described with reference to its preferred embodiments. Those of ordinary skill in the art may, upon reading this disclosure, appreciate changes or modifications which do not depart from the scope and spirit of the invention as described above or claimed hereafter.

What we claim is:

1. A method for decreasing the resistance to fluid flow in a subterranean formation around a well having unperforated casing fixed therein, the casing extending at least partially through the formation, comprising:

(a) providing a liquid in the casing opposite the formation to be treated;

(b) placing perforating means in the casing at a depth opposite the formation to be treated;

(c) injecting gas into the well until the pressure in the liquid opposite the formation to be treated will be at least as large as the fracturing pressure of the formation when the liquid pressure is applied to the formation;

(d) activating the perforating means; and (e) at a time before pressure in the well at the depth of the formation to be treated has substantially decreased, injecting fluid at an effective rate to fracture the formation.

2. The method of claim 1 wherein the liquid pressure applied to the formation in step (c) is at least 0.5 psi per foot of depth of the formation.

3. The method of claim 1 wherein the liquid pressure applied to the formation in step (c) is at least 1.0 psi per foot of depth of the formation.

4. The method of claim 1 wherein the liquid of step (a) comprises a liquid selected from the group consisting of water, brine, oil, aqueous acid solution and hydrocarbon solvent.

5. The method of claim 1 wherein the fluid of step (e) is a mixture of gas and liquid.

6. The method of claim 5 wherein the gas of step (e) comprises at least one gas selected from the group consisting of gaseous nitrogen, gaseous carbon dioxide, and natural gas.

7. The method of claim 5 wherein the liquid of step (e) comprises at least one liquid selected from the group consisting of water, brine, oil, aqueous acid solution, and hydrocarbon solvent.

8. The method of claim 5 wherein the volume of liquid is greater than 5 per cent and less than 95 per cent of the volume at injection pressure of the fluid injected.

9. The method of claim 5 wherein proppant particles are added to the liquid before it is injected.

10. A method for decreasing the resistance to fluid flow in a subterranean formation around a well having an optionally perforated casing fixed therein, the casing extending at least partially through the formation, comprising:

(a) placing a tubing string in the well, the tubing string having a packer, perforating means and pressure release means attached thereto, such that the perforating means is opposite the formation to be treated;

(b) setting the packer so as to seal the annulus between the casing and the tubing string;

(c) injecting a fluid into the tubing string such that when pressure within the tubing string is released the fluid pressure at the depth of the formation to be treated is greater than the fracture pressure of the formation;

d) activating the perforating means and near simultaneously activating the pressure release means to release pressure from the tubing string into the casing below the packer such that pressure is applied to the formation through existing or newly created perforations.

11. The method of claim 10 additionally comprising the step:

(e) at a time before pressure in the well at the depth of the formation to be treated has substantially decreased, injecting a fluid at an effective rate to fracture the formation.

12. The method of claim 10 wherein the pressure at the depth of the formation to be treated of step (c) is at least 0.5 psi per foot of depth of the formation.

13. The method of claim 10 wherein the pressure at the depth of the formation to be treated of step (c) is at least 1.0 psi per foot of depth of the formation.

14. The method of claim 11 wherein the fluid of step (e) is a mixture of gas and liquid.

15. The method of claim 14 wherein the gas of step (e) comprises at least one gas selected from the group consisting of gaseous nitrogen, gaseous carbon dioxide and gaseous natural gas.

16. The method of claim 14 wherein the liquid of step (e) comprises at least one liquid selected from the group consisting of water, brine., oil, aqueous acid solution and hydrocarbon solvent.

17. The method of claim 14 wherein the volume of liquid is in the range from about 5 per cent to about 95 per cent of the volume at injection pressure of the fluid injected.

18. The method of claim 14 wherein the volume of liquid is in the range from about 5 per cent to about 20 per cent of the volume at injection pressure of the fluid injected.

19. The method of claim 14 wherein particles are added to the liquid before it is injected.

20. The method of claim 19 wherein the particles are in the size range from 8 mesh to 100 mesh.

21. The method of claim 19 wherein the concentration of particles in the liquid is in the range from about 0.1 to about 20 pounds per gallon of liquid.

22. The method of claim 10 wherein the perforating means and the pressure release means of step (d) are activated by a device selected from the group consisting of a drop bar percussion firing head and a hydraulic firing head.

23. The method of claim 10 wherein the pressure release means of step (d) is selected from the group consisting of a vent sub, a ported sub and a gun drop device.

24. A method for decreasing the resistance to fluid flow in a subterranean formation around a well having casing fixed therein, the casing extending at least partially through the formation, comprising:

(a) placing a tubing string in the well, the tubing string having a packer attached thereto;
(b) setting the packer so as to seal the annulus between the casing and the tubing string;
(c) placing perforating means below the tubing string and located opposite the formation to be treated, the perforating means being conveyed into the well on wireline;
(d) injecting a gas phase into the tubing string until the pressure in the casing opposite the formation to be treated is at least as large as the fracturing pressure of the formation;
(e) activating the perforating means to form at least one perforation in the casing; and
(f) at a time before pressure in the well at the depth of the formation to be treated has dropped substantially below fracturing pressure, injecting a fluid at an effective rate to fracture the formation.

25. The method of claim 24 wherein the pressure in the casing at the depth of the formation to be treated of step (d) is at least 0.5 psi per foot of depth of the formation.

26. The method of claim 24 wherein the pressure in the casing at the depth of the formation to be treated of step (d) is at least 1.0 psi per foot of depth of the formation.

27. The method of claim 24 wherein the fluid of step (f) is a mixture of gas and liquid.

28. The method of claim 24 wherein the gas of step (f) comprises at least one gas selected from the group consisting of gaseous nitrogen, gaseous carbon dioxide and gaseous natural gas.

29. The method of claim 24 wherein the liquid of step (f) comprises at least one liquid selected from the group consisting of water, oil, aqueous acid solution and hydrocarbon solvent.

30. The method of claim 24 wherein the volume of liquid is in the range from about 5 per cent to about 95 per cent of the volume of fluid at injection pressure of the fluid injected in step (f).

31. The method of claim 24 wherein the volume of liquid is in the range from about 5 per cent to about 20 per cent of the volume of fluid at injection pressure of the fluid injected in step (f).

32. The method of claim 24 wherein particles are added to the liquid before it is injected in step (f).

33. The method of claim 32 wherein the particles are in the size range from 8 mesh to 100 mesh.

34. The method of claim 32 wherein the concentration of particles in the liquid is in the range from about 0.1 to about 20 pounds per gallon of liquid.

35. The method of claim 24 wherein before step (d) existing perforations in the casing are effectively plugged with a diverting material.

36. A method of decreasing the resistance to fluid flow in a subterranean formation surrounding a well having casing fixed therein, the casing extending at least partially through the formation and having at least one perforation in the casing opposite the formation, comprising:

(a) placing a tubing string in the well, the tubing string having a packer and a means for containing high pressure, said means being located in proximity to the lower end of said tubing;
(b) setting the packer so as to seal the annulus between the casing and the tubing string;
(c) injecting a gas phase into the tubing string such that when pressure within the tubing string is released the fluid pressure in the well at the depth of the formation to be treated is greater than fracture pressure of the formation;
(d) activating the means for containing high pressure such that pressure is instantaneously applied to the formation through the perforations;
(e) at a time before pressure at the perforations has dropped substantially below fracturing pressure of the formation, injecting a fluid at an effective rate to fracture the formation.

37. The method of claim 36 wherein the fluid pressure at the depth of the formation to be treated of step (c) is at least 0.5 psi per foot of depth of the formation.

38. The method of claim 36 wherein the fluid pressure at the depth of the formation to be treated of step (c) is at least 1.0 psi per foot of depth of the formation.

39. The method of claim 36 wherein the fluid of step (e) is a mixture of gas and liquid.

40. The method of claim 39 wherein the gas of step (e) comprises at least one gas selected from the group consisting of gaseous nitrogen, gaseous carbon dioxide and gaseous natural gas.

41. The method of claim 39 wherein the liquid of step (e) comprises at least one liquid selected from the group consisting of water, brine, oil, aqueous acid solution and hydrocarbon solvent.

42. The method of claim 39 wherein the volume of liquid is in the range from about 5 per cent to about 95 per cent of the volume at injection pressure of the fluid injected.

43. The method of claim 39 wherein the volume of liquid is in the range from about 5 per cent to about 20 per cent of the volume at injection pressure of the fluid injected.

44. The method of claim 39 wherein particles are added to the liquid before it is injected.

45. The method of claim 44 wherein the particles are in the size range from 8 mesh to 100 mesh.

46. The method of claim 44 wherein the concentration of particles in the liquid is in the range from about 0.1 to about 20 pounds per gallon of liquid.

47. The method of claim 36 wherein the means for containing high pressure is selected from the group consisting of a frangible disc, a pressure controlled valve and a pump out device.

48. A method for decreasing the resistance to fluid flow in a subterranean formation surrounding a well having casing fixed therein, the casing extending at least partially through the formation, comprising:

(a) providing a liquid in the casing at the depth of the formation to be treated;

(b) placing perforating means in the casing at a depth opposite the formation to be treated;

(c) injecting a gas into the well until the pressure in the liquid opposite the formation to be treated is at least as large as the fracturing pressure of the formation;

(d) activating the perforating means; and (e) at a time before pressure in the well at the depth of the formation to be treated has substantially decreased, injecting fluid at an effective rate to fracture the formation.

49. The method of claim 48 wherein the casing has at least one perforation and diverting materials are injected into the well to plug any perforation before step (c).

* * * * *